US005101747A

United States Patent [19]

Gerber

[11] Patent Number: 5,101,747

[45] Date of Patent: Apr. 7, 1992

[54] APPARATUS AND METHOD FOR SEPARATING PATTERN PIECES FROM WASTE MATERIAL

[75] Inventor: Heinz J. Gerber, West Hartford, Conn.

[73] Assignee: Gerber Garment Technology, Inc., Tolland, Conn.

[21] Appl. No.: 584,501

[22] Filed: Sep. 14, 1990

Related U.S. Application Data

[63] Continuation of Ser. 452,621, Dec. 19, 1989, abandoned.

[51] Int. Cl.[5] ..... B26D 7/18

[52] U.S. Cl. ..... 112/121.14; 83/27; 83/103; 83/104; 83/105; 112/121.29

[58] Field of Search ..... 83/27, 109, 937-939, 83/101, 103-105, 107, 155.1; 198/631; 225/98, 99; 112/121.14, 121.29

[56] References Cited

U.S. PATENT DOCUMENTS

| | | | |
|---|---|---|---|
| 2,167,734 | 8/1939 | Zonino | 225/99 X |
| 2,789,640 | 4/1957 | Belden | 225/99 X |
| 2,881,836 | 4/1959 | Thien et al. | 83/109 X |
| 2,888,860 | 6/1959 | Baumgartner | 83/103 X |
| 3,019,824 | 2/1962 | Bakke | 83/103 X |
| 3,055,567 | 9/1962 | Sayford, Jr. | 225/99 X |
| 3,516,464 | 7/1968 | Cyr | 83/103 X |
| 3,765,349 | 10/1973 | Gerber | 83/941 X |
| 3,807,610 | 4/1974 | Mueller, Jr. | 225/99 X |
| 4,530,693 | 7/1985 | Isowa | 83/139 X |
| 4,546,683 | 10/1985 | Völkel et al. | 83/103 X |
| 4,834,275 | 5/1989 | Kittel | 225/96.5 |

FOREIGN PATENT DOCUMENTS

| | | |
|---|---|---|
| 0363348 | 9/1989 | European Pat. Off. . |
| 363349 | 4/1990 | European Pat. Off. . |
| 384914 | 8/1990 | European Pat. Off. . |

*Primary Examiner*—Mark Rosenbaum
*Assistant Examiner*—Kenneth E. Peterson
*Attorney, Agent, or Firm*—McCormick, Paulding & Huber

[57] ABSTRACT

In a cutting system and method for cutting pattern pieces from flexible sheet material, after the cutting the cut pattern pieces are separated from the waste material by moving the material forwardly to a separating station at which the waste material is pulled from one point to another so as to be tensioned and constrained to move along one path to one delivery station, while cut pattern pieces are not similarly pulled or tensioned but instead are allowed to move by gravity to a different path leading to another delivery station. An associated means, such as a roll with a resilient outer surface or a plurality of plungers, applies forces to the material to aid gravity in the separation of the pattern pieces by tending to push such pieces from the waste material. The material may also be vibrated to assist in the dislodgment of the pattern pieces from the waste material.

28 Claims, 3 Drawing Sheets

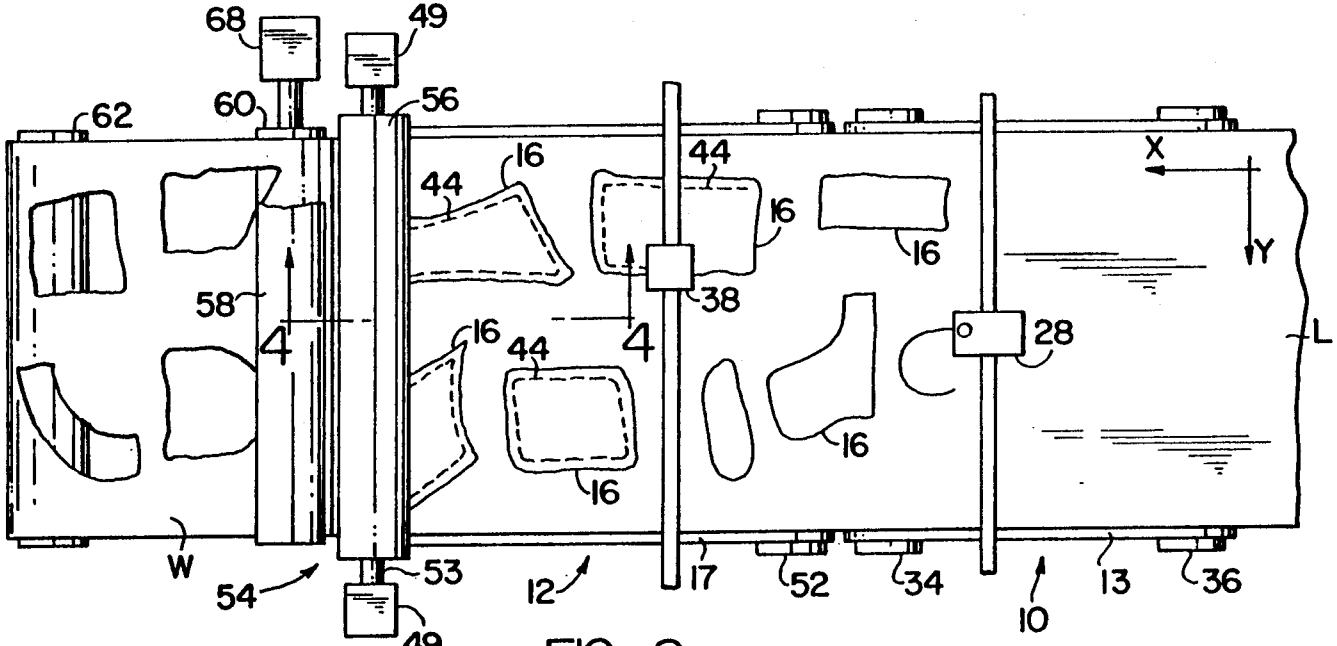
FIG. 2
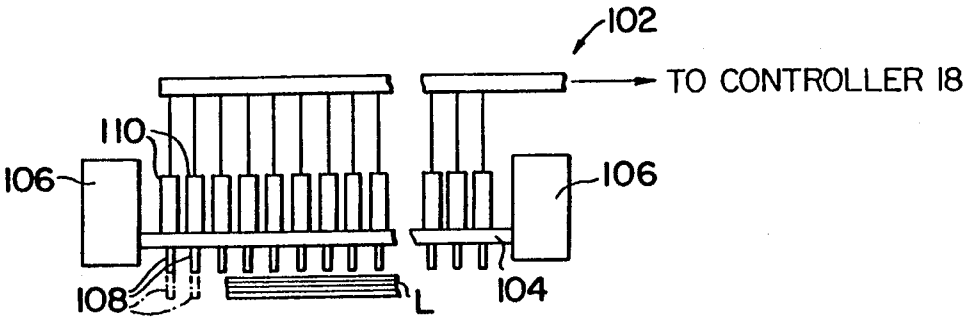
FIG. 7
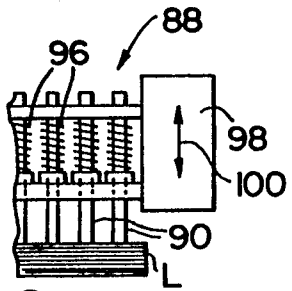
FIG. 6
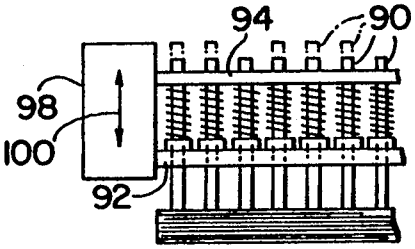

APPARATUS AND METHOD FOR SEPARATING PATTERN PIECES FROM WASTE MATERIAL

This is a continuation of co-pending application Ser. No. 07/452,621 filed on Dec. 12, 1989 now abandoned.

BACKGROUND OF THE INVENTION

The present invention relates generally to systems for cutting pattern pieces from textiles or similar flexible sheet material, and deals more particularly with an apparatus and method for separating cut pattern pieces from adjacent waste material following the cutting operation.

The invention is particularly well adapted for use in a fully automated cutting system including at least one conveyor table for supporting sheet material and for feeding it to and from a cutting station, and it is therefore herein illustrated and described in association with such a system. The invention is not, however, necessarily limited to such a system and may also be used beneficially with non-automated or semi-automated systems an with systems using one or more non-conveyor tables with fixed material supporting surfaces, the material being slid over such supporting surfaces in being moved from one work station to another.

Conveyor cutting tables are known for use in feeding sheet material to and from a cutting station associated with the table. In some applications a single layer of sheet material may be supported and fed by the table, and in other applications the table may be used to feed and support a layup of material formed by spreading multiple layers of sheet material on top of one another prior to the cutting operation. The cutting of a layup rather than a single layer has the advantage that a single traversal by the cutting tool of a cutting path having a shape corresponding to the periphery of a pattern piece cuts from the layup an entire stack of such pattern pieces. The pattern pieces to be cut from either a single layer or a layup of material are generally initially laid out in a cutting pattern, referred to as a "marker", to provide an optimal arrangement of the pattern pieces maximizing usage of the material and leaving as little waste material as possible.

The entire process of cutting sheet material, either in single layers or in layups, involves basically the three steps of spreading the sheet material, cutting the spread material, and separating the cut pieces from the waste material. When cutting a single layer of sheet material, or a layup containing only a few layers, the material is sometimes fed from one or a small number of fixed supply rolls directly to the cutting station, so that the spreading occurs at or near the cutting station. More usually however, especially in the case of cutting high layups, the material is spread over a relatively long spreading surface in advance of being moved to the cutting station. This spreading surface may be formed by an advance portion of the same conveyor table as provides the cutting station, or in other cases may be provided by a separate non-conveyor or conveyor table from which the spread material is moved to the cutting table at the proper time.

The step of separating the cut pieces from the waste material may be accomplished by stopping the cutting process, after a given longitudinal portion of the material is cut at the cutting station, and then removing the cut pieces by picking them up by hand from the cutting station before a fresh uncut portion of material is moved to the cutting station for subsequent cutting. To improve the efficiency of the cutting station, it is also known to move the cut portion of sheet material to a separate take-off station where the process of separating the cut pieces from the waste material can take place while the cutting station operates on a fresh portion of material. In some instances the take-off station may be provided by a portion of the same conveyor table as provides the cutting station, and in other instances the take-off station may constitute a separate table to which the cut portion of material is moved following its cutting at the cutting station.

It is also known from U.S. Pat. No. 3,765,349, when cutting layups of sheet material, to bundle the cut stacks of pattern pieces by inserting stitches or fasteners into the stacks, so that the bundled stacks can then be more readily removed from the waste material at the take-off station, and so that the stacks will remain intact until reaching a subsequent sewing or other work station. This bundling may occur at the cutting station, at the take-off station or at some other station.

In any event, the removal of the cut pieces from the waste material, whether dealing with single pieces cut from a single layer or with stacks of pieces cut from a layup, is a relatively time-consuming operation since it requires one or more persons to locate, grasp, lift and transfer to a suitable receptacle or delivery station each pattern piece or stack of pattern pieces. Some attempts have been made or contemplated in the past to automate this operation through the use of robots simulating the work of human operators, but this in turn requires relatively costly and complex equipment and associated control systems.

The general object of this invention is therefore to provide a simple apparatus and method for use in a sheet material cutting system for separating cut pattern pieces from waste material after the sheet material is cut at a cutting station, the apparatus and method eliminating the need for human operators or robot type separating equipment.

Other objects and advantages of the invention will be apparent from the following detailed description of a preferred embodiment and from the accompanying drawings and claims.

SUMMARY OF THE INVENTION

The present invention resides in an apparatus and method for separating out pieces from adjacent waste material in a sheet material cutting system. The marker dictating the shape and arrangement of the pattern pieces to be cut from the material is preferably designed so that substantially all of the waste material portions are interconnected in one unit extending along the length of the material to be cut, or in a small number of units each extending along the length of the material to be cut. Following the cutting of the material at the cutting station, the material is moved forwardly along a horizontal path while it is initially supported from below, and, at a given, point in such forward movement the waste material is pulled so as to be tensioned and constrained to move along one path which while the pattern pieces are untensioned and permitted to move by gravity from the waste material to a different path, thereby causing separation of the pattern pieces from the waste material. For example, the waste material may be pulled upwardly from the horizontal path along an upwardly extending path having an initial curved portion. The cut pattern pieces or stacks of pattern pieces are not, however, pulled upwardly or otherwise constrained to move upwardly along the same path as the waste material and are therefore separated from the waste material by moving horizontally and/or downwardly through a space adjacent to the path of the waste material to a receptacle or other delivery station as the waste material moves upwardly and to a different receptacle or delivery station. As another example, the waste material may be pulled horizontally so as to be constrained to move in a continuation of the initial horizontal path and over, a space or gap in the bottom supporting means so that when the untensioned cut pattern pieces reach such space, they are free to fall downwardly by gravity through the space and from the waste material.

In cases where a layup of sheet material is being cut, the invention also resides in the stacks of pattern pieces being bundled by applying stitches, staples or other fastening means thereto, so that the stacks arrive at the separating station in bundled condition.

The invention also resides in a means for applying a resilient pressure or other forces to the sheet material over an area extending transversely of the sheet material so as to assist gravity by tending to push the cut pattern pieces from the waste material.

The invention also resides in the work material being vibrated at or near the separating station to aid in separating the cut pattern pieces from the waste material.

The invention further, more specifically, resides in the separating means including a rotatable separating roll extending transversely over the cut sheet material which roll has a resilient outer surface pressed against the material so as to apply said resilient pressure to the sheet material.

Still more specifically, the invention resides in the separating roll having a resilient outer surface formed by a multitude of flexible normally radially extending bristles.

The invention also resides in the separating means including a plurality of plungers at the separating station operable to aid in pushing the cut pattern pieces from the waste material.

BRIEF DESCRIPTION OF THE DRAWINGS

FIG. 2 is a schematic plan view of the system of FIG. 1.

FIG. 6 is a fragmentary view taken on the line 6—6 of FIG. 5 showing the plunger mechanism of FIG. 5 in more detail.

FIG. 7 is a view similar to FIG. 6 showing an alternate form of plunger mechanism.

DETAILED DESCRIPTION OF THE PREFERRED EMBODIMENTS

Turning now to the drawings, the figures show, by way of example, a sheet material cutting system embodying the present invention and including both a conveyor type cutting table 10 and a separate conveyor type take-away table 12. This system is shown as applied to the cutting of a layup L of sheet material consisting of a relatively large number of layers of fabric or similar flexible sheet material spread on top of one another. As is known, the spreading of the layup may take place on a separate spreading table located in advance of the cutting table 10 with the layup after being formed being delivered to the cutting table in a suitable way.

Figure 1:
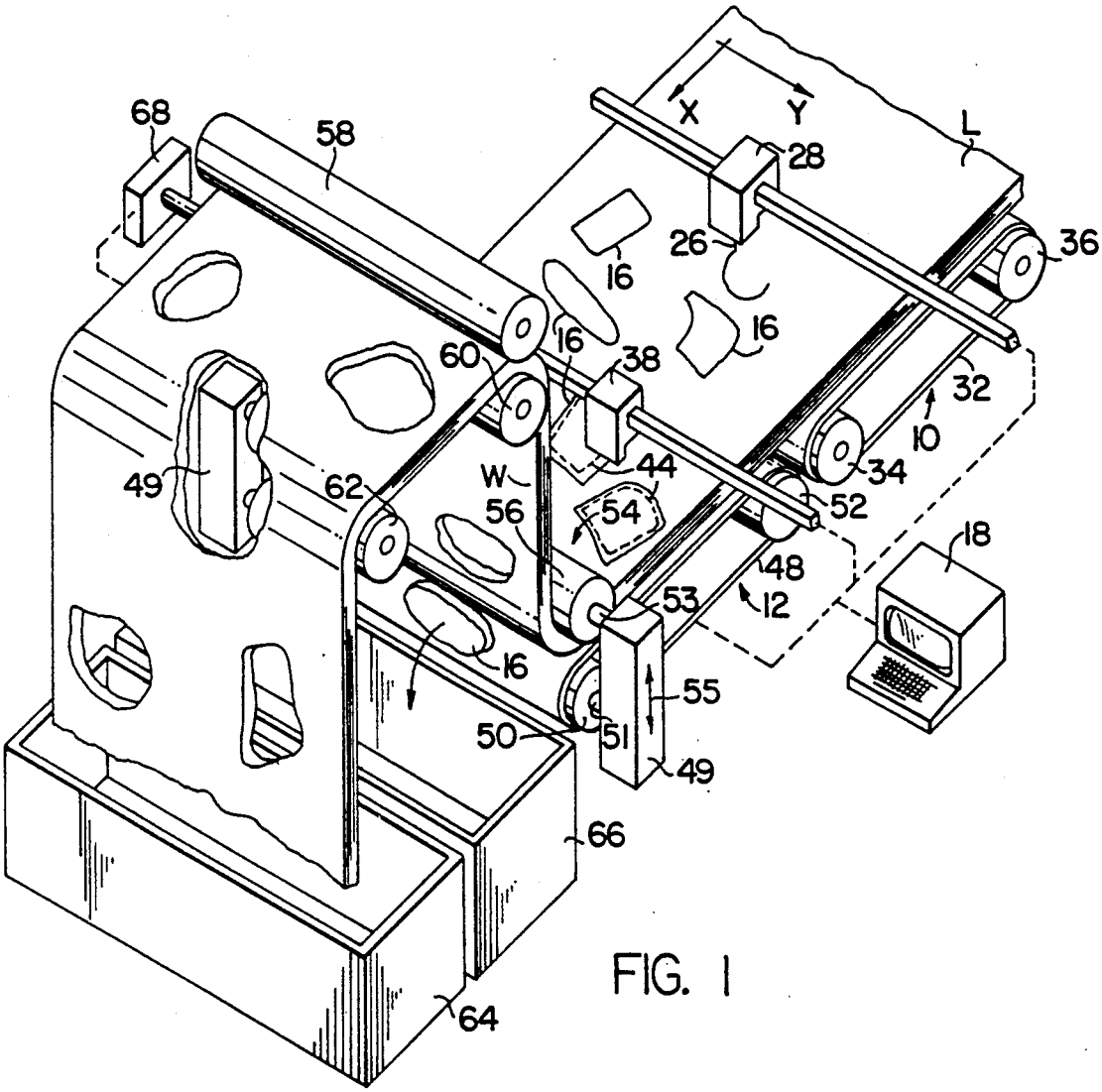
FIG. 1 is a schematic perspective view of a sheet material cutting system embodying the present invention.

The cutting table 10 provides a cutting station with which is associated a cutter head 28, having a cutting tool 26, suitably supported in any well-known wa for movement in the illustrated X and Y coordinate directions relative to the layup L so as to be capable of cutting stacks of pattern pieces, such as illustrated a 16, from the layup as the layup is progressively advanced past the cutting station. The movement of the cutter head 28 during the cutting operation is automatically controlled by an associated controller 18 in accordance with a pre-determined marker stored in the memory of the controller and defining the shape and arrangement of the stacks of pattern pieces cut from the layup. In FIG. 1, for convenience of illustration, the stacks 16 of pattern pieces are shown to be relatively widely separated from one another. In an actual situation, however, the marker is usually so designed that the stacks of pattern pieces are located much closer to one another in a carefully selected arrangement to maximize usage of the layup material. In any event, in keeping with the invention it is desirable, as in the case of FIG. 1, that the portions of the waste material surrounding the cut stacks be substantially all interconnected with one another so as to form a single unit W of waste material extending the entire length of the layup L. That is, there are preferably few, if any, islands or separate portions of waste material not connected with the unit W. It is, however, also acceptable, as will be evident from the following description, for the waste material portions being so interconnected as to consist of two, or some other small number of, units each constituting a different transverse section of the waste material and each extending the entire length of the material.

After the layup L is cut by the cutting head 28, it is moved onto the take-off table 12, which in the illustrated instance provides a bundling station for bundling the cut stacks 16. The apparatus used to perform the bundling may take various different forms and, for purpose of illustration, is shown to comprise a bundling head 38 having a needle for stitching thread into the cut stacks of pattern pieces to hold such stacks in bundled condition. A suitable form of such a bundler is shown in U.S. Pat. No. 3,675,349. The head 38 is supported in suitable fashion for movement in the illustrated X and Y coordinate directions so as to be able to follow, for each stack of pattern pieces, a corresponding stitch line, such as one of the ones illustrated at 44, suitable for bundling the stack. The movement and operation of the bundling head 38 is controlled by the controller 18 in response to the same stored marker information as used to control the cutting head 88. It should be understood, however, that the use of stitches to form the stacks into bundles has been chosen for illustration purposes and that the stacks may be formed into bundles in other ways without departing from the invention, as for example, by inserting staples or other fasteners into the stacks. Also, if desired, the bundling head may be used to insert stitches, staples or other fasteners into the waste material at selected points to hold its layers in assembled condition. Especially, if the cutting of the pattern pieces from the layup leaves some islands of waste material unconnected to the main portion or portions of waste material, the bundling head may be used to insert stitches, staples or other fasteners into such islands to hold their layers in assembled or bundled condition. It should also be understood that the insertion of the bundle forming stitches, staples or other fasteners need not occur after the cutting of the pattern pieces but may also, if desired, occur in advance of the cutting.

Figure 3:
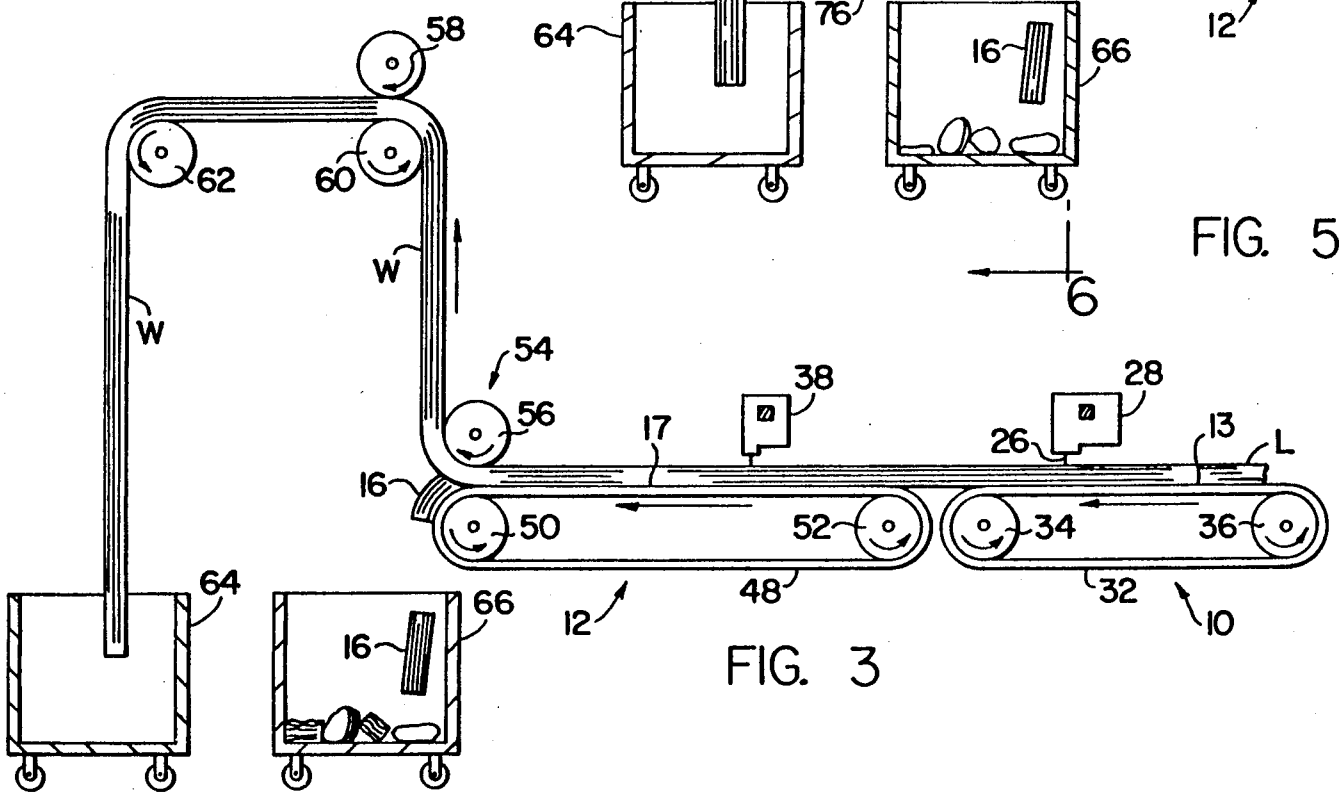
FIG. 3 is a schematic side view of the system of FIG. 1.

Both the cutting table 10 and the take-away table 12 may be conveyor tables generally similar to that shown by U.S. Pat. No. 4,646,911. As best shown in FIG. 3, the table 10 includes a conveyor belt 32 trained about forward and rear end wheels 34 and 36, respectively, and the table 12 includes a conveyor belt 48 trained about forward and rear end wheels 50 52, respectively. The outer portion of each belt 32 and 48 may, and preferably does, consist of a bed of bristles the outer ends of which define the outer surface of the belt. Along the upper run of the belt 32, its outer surface provides an upwardly facing horizontal surface 13 for supporting the layup L during cutting by the cutter head 28, while along its upper run the outer surface of the belt 48 provides an upwardly facing horizontal surface 17 for supporting the layup L during bundling of the out stacks 16 by the bundling head 38.

In accordance with the invention, after the layup L is cut by the cutting head 28, and the cut stacks of pattern pieces bundled by the bundling head 38, the layup is moved forwardly, that is to the left in FIGS. 2 and 3, along a horizontal path defined by the forward movement of the upper run of the conveyor belt 48 of the take-away conveyor 12 to a separating means forming a separating station located at one point along said path and indicated generally at 54. This separating means includes a separating member extending transversely across the path of material movement and providing a curved surface about which the waste material can be diverted so as to move from the horizontal path of movement to a generally upwardly directed path of movement, combined with a means for pulling the waste material upwardly so that it is tensioned and does move upwardly around the separating member from its original horizontal path of movement to an upwardly directed one. The upwardly directed pulling force applied to the waste material is not, however, directly applied to the cut pattern pieces with the result that as the waste material is pulled upwardly around the curved path provided by the separating member the cut pattern pieces are untensioned and are free to fall by gravity from the waste material so as to become separated therefrom. During this separation the cut pattern pieces move through a space 59 adjacent and downstream of the separating roll 56 which extends completely transversely across the width of the layup L without interruption so that no physical barrier is present to prevent a cut pattern piece from moving from the waste material at any point across the width of the layup. The separating means also preferably includes a means for applying a resilient pressure to the sheet material in the vicinity of the separating member and over an area extending transversely of the sheet material which pressure is directed generally normal to the surface of the sheet material so as to tend to push the cut pattern pieces from the waste and to thereby assist the force of gravity in separating the cut pattern pieces from the waste. If desired, the work material may also be vibrated at or near the separating station to further aid in dislodging the cut pattern pieces from the waste material.

The separating member providing the curved guide surface, the means for pulling upwardly on the waste material, the means for applying a resilient pressure to the sheet material in the vicinity of the separating member, and the means for vibrating the work material may take various different forms without departing from the spirit of the invention. However, in the illustrated case, the separating member is a rotatable separating roll 56 extending transversely across the path of movement of the layup L and rotatable about its horizontal axis. The means for pulling upwardly on the waste material W comprises two counter-rotating rolls 58 and 60, at least one of which is driven, located above the separating roll 56 and between which the waste material W passes. Following the rolls 58 and 60 is a further roll 62 which delivers the waste material to a separate receptacle 64 or other delivery station. In the illustrated case, the separating roll 56 is located substantially in the same vertical zone as the forward wheel 50 of the take-off conveyor 12. This arrangement is not however critical and, if desired, the separating roll ma alternatively be located either somewhat forwardly of or rearwardly of the forward conveyor wheel 50. Location of the separating roll either substantially directly above the conveyor wheel 50 or slightly forwardly of it does, however, have the result that after a bundled stack 16 of pattern pieces starts to move from the waste material it may move downwardly below the level of the horizontal path provided by the upper run of the conveyor belt 48 so that the weight of the downwardly extending portion of the partially removed stack will aid in moving the remainder of the stack from the waste material.

The vibrating means is preferably such as to shake the layup generally vertically in the vicinity of the separating roll 56 to help loosen the bundled stacks of pattern pieces from the waste material. In the illustrated case, this means consists of two vibrators 49 located on opposite sides of the table 12, which are driven in synchronism with one other, and each of which is connected with the two shafts 51 and 53 of the conveyor wheel 50 and separating roll 56, respectively, so as to vibrate the wheel 50 and separating roll 56, and the layup which passes therebetween, vertically as indicated by the arrow 55 of FIG. 1. The amplitude and frequency of the vibrations are set at values most effective in aiding the loosening of the bundled pattern pieces from the waste and may, for example, be a peak-to-peak amplitude within the range of 1/16 to ½ inch and a frequency with the range of 20 to 200 Hz. It should be understood, however, that in many cases acceptable separation of the bundled pattern pieces may be had without vibrating the work material, and that in those cases, the vibrating means may be omitted without departing from the broader aspects of the invention.

In the so far described detailed construction and operation of the separating means 54, the separation of each stack 16 of cut pattern pieces from the waste material W occurs in that as the waste material moves upwardly around the separating roll 56, the weight of the cut stack causes it not to be lifted with the waste material but instead to move forwardly and downwardly away from the waste material and to a separate receptacle 66 or other delivery station. Preferably, however, the construction and operation of the separating means is further such that the waste material as it passes along the curved guide surface diverting it from the horizontal path of movement to the upper path of movement is tensioned, without any tension being applied to the cut pattern pieces, and in the vicinity of the curved guide surface is a means which applies a resilient pressure to the material over an area extending transversely of the material. Therefore, as a section of material passes over the involved area, the resilient pressure is resisted by the tensioned waste material but not by the non-tensioned cut pattern pieces, so that the resilient pressure tends to push the cut pieces from the waste material.

In the illustrated case (see FIG. 1), the means for maintaining a tension force in the upwardly extending portion of the waste material W includes a drive means 68 for the drive roll 60 which is controlled by the controller 18 and which includes an electromagnetic clutch or the like to apply a bias in the counter-clockwise or feed direction to the roll 60 at all rates of forward movement of the sheet material as dictated by movement of the conveyor 12. As illustrated, the roll 58, the separating roll 56 and the roll 62 are freely rotatable. However, if desired, the roll 58 and the roll 62 may be drivingly connected with the feed roll 60 so as to be driven in unison therewith, and the separating roll 56 may be drivingly connected with the conveyor wheel 50 so as to be driven in unison with it.

The resilient pressure applying means located adjacent the curved path along which the waste material is diverted upwardly from its horizontal path may take various different forms and may, if desired, be separate from the separating roll 56. Preferably however, such means are located on the separating roll 56. In such case, the resilient pressure applying means may take the form of a layer of sponge rubber or similar material forming the outer surface of the roll or may take the form of a large number of radially depressible fingers distributed over the surface of the roll and each biased outwardly by a mechanical or air spring.

Figure 4:
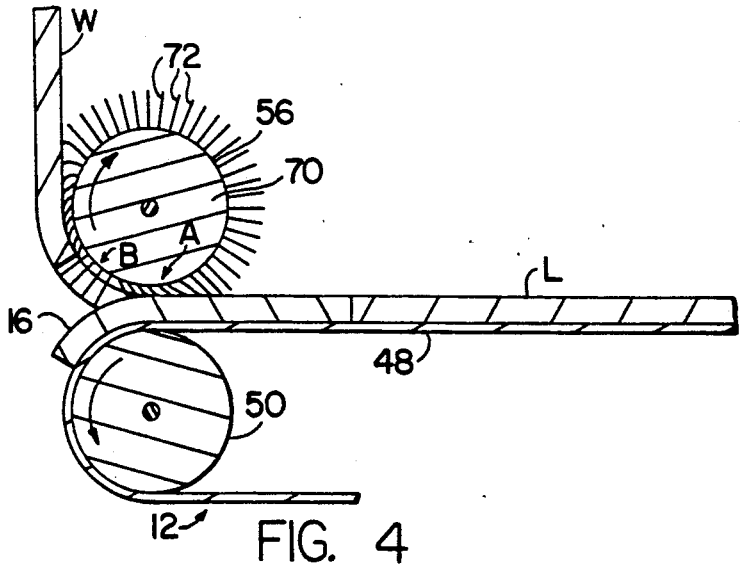
FIG. 4 is a fragmentary vertical sectional view taken on the line 4—4 of FIG. 2.

In the illustrated case, the resilient pressure applying means, as shown in FIG. 4, is provided by constructing the separating roll 56 so as to be comprised of an inner cylindrical body carrying a large number of bristles 72 extending generally radially outwardly from the inner body 70 and having outer ends defining the outer surface of the roll. Although the bristles normally extend radially outwardly from the inner body 70, they are resiliently flexible. Therefore, as shown in FIG. 4, as a portion of the layup L approaches the separating roll 56, all of the bristles 72 extending transversely of the roll in the region A are deflected due to the bristles coming into engagement with the top surface of the layup and being incapable of moving the material downwardly due to the underlying presence of the conveyor band 48. As the material moves further forwardly, however, it moves to the region B in which those bristles which engage the waste material are still maintained in a bent condition, being held in such condition by the opposing tension in the waste material W. However, in the region B, those bent bristles 72 which engage a out stack 16 of sheet material exert a force on the cut stack which is not resisted by any tension in the cut stack. Therefore, the bristles engaging the stack tend to return to their normal uninflected states and in so doing push the stack from the waste material to assist the weight of the stack in separating it from the waste material.

Figure 5:
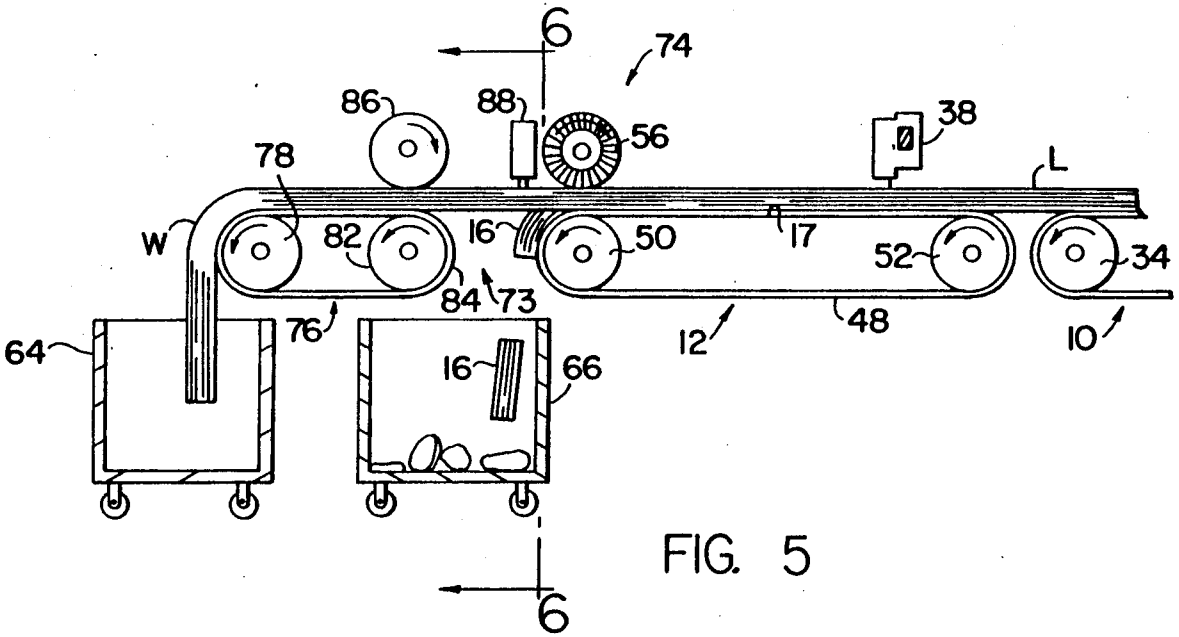
FIG. 5 is a view similar to FIG. 3 but showing another embodiment of the invention.

In its broader aspects, the invention resides in the fact that the work material after the cutting out of the pattern pieces is initially moved along a horizontal path and supported from below and then, at the separating station, the pattern pieces and waste material are caused to move along two different paths. This divergence of the paths, with the waste material being pulled and thereby tensioned and caused to move along its path against the force of gravity, and with the cut pattern pieces being untensioned and thereby being urged by gravity to move from the waste material to their path of the pattern pieces and the waste material may in turn be accomplished by, at the separating station, terminating the support from below to allow the pattern pieces to fall downwardly from the level of the horizontal path while the waste material is pulled along such other path as to be tensioned and constrained against falling downwardly with the pattern pieces. In the previously described embodiment of the invention, as illustrated in FIGS. 1–6, the waste material is pulled upwardly at the separating station while the pattern pieces are free to fall downwardly relative to the waste material. This upward moment of the waste material is not, however, necessary in all embodiments of the invention and, if desired, other handling of the waste material as it passes the separating station may be employed. As an example of such other handling, the waste material may, instead of being pulled upwardly at the separating station, be pulled horizontally so as to be constrained to continue its initial horizontal movement and to move over a free space or gap, extending entirely across the width of the waste material without interruption, at which support from below is absent, thereby allowing the pattern pieces to fall downwardly from the waste material and through the space to one delivery station while the waste material moves to a different delivery station. A system embodying this principle is shown in FIG. 5.

Referring to FIG. 5, the cutting and bundling means of the illustrated system are the same as those of FIGS. 1–4, have been given the same reference numerals, and are not redescribed.

In FIG. 5 the separating means is indicated generally at 74. At the separating station the vertical support from below provided by the belt 48 of the conveyor 12 terminates, but the waste material W is constrained to continue along its initial horizontal path of movement and over a space or gap 73 to a further conveyor 76 comprised of end wheels 78 and 82 and belt 84. Above the wheel 82 is a pinch roll 86, and the speed of the conveyor 76 is so controlled in relation to the speed of the conveyor 12 that the portion of the waste material extending over the space 73 is pulled across that space so as to be maintained in tension or at least kept from sagging downwardly to any appreciable extent. Therefore, it will be obvious that as the waste material moves over the space 73 the cut and bundled stacks 16 of pattern pieces are free to fall downwardly from the waste material and through the space 73 to a delivery station such as illustrated by the bin 66. The conveyor 76, in turn moves the waste material to a different delivery station as represented by the bin 64.

The illustrated separating means 74 of FIG. 5 includes the same separating roll 56 as used in the separating station 54 of FIGS. 1–4. It will, of course, be understood that other means may be used instead of or in combination with the separating roll 56 to aid in the removal of the pattern pieces from the waste material. Such additional means may include means, such as the vibrators 49,49 of FIGS. 1 and 2, to vibrate the material in the vicinity of the separating station or a mechanism with plungers moveable generally normal to the waste material to aid in pushing the pattern pieces from the waste material, such a plunger mechanism being indicated at 88 in FIG. 5.

A suitable form of plunger mechanism 88 is shown in FIG. 6. Referring to that Figure, the mechanism 88 includes a plurality of plungers 90,90 slideably supported by two horizontal bars 92 and 94. Each plunger 90 is biased to a downwardly limited position by an associated compression spring 96. The two bars 92 and 94 at their opposite ends are connected to two vibrators 98,98 which oscillate the bars 92,94 vertically as indicated by the arrows 100,100. The location and amplitude of oscillation of the bars 92,94 is such that when the bars are in their uppermost positions the plungers 90,90 will all be in their lowermost positions relative to the bars 92,94, to which positions they are biased by the springs 96,96, with the lower ends of the plungers being slightly spaced above the top surface of the layup L. Then, when the bars 92,94 move downwardly the lower ends of the plungers 90 engage the top surface of the layup. As the bars continue moving downwardly those plungers which engage the waste material will be arrested in their downward moment by the waste material and will move upwardly relative to the bars 92,94. On the other hand, those plungers engaging bundles of cut pattern pieces will continue to move downwardly and will thereby exert forces on the engaged bundle pushing them from the waste material. The frequency and amplitude of vibration of the plunger mechanism 88 may vary, but for example may be such as to provide a peak-to-peak oscillation within the range of ¼ inch to 1 inch and a frequency of 5-20 Hz.

In the plunger mechanism 88 of FIG. 6 the movement of any given plunger 90 is dependent only on whether during a given oscillation its lower end encounters the waste material or a pattern piece. If desired, however, an alternate plunger mechanism may be used wherein the plungers are individually moved by actuators controlled by the controller so that as a portion of the layup moves under the plunger mechanism only those plungers aligned with pattern pieces are actuated to push those pattern pieces from the waste material. Such a plunger mechanism is illustrated at 102 in FIG. 7. It comprises a horizontal bar 104 extending transversely over the layup L and supported at opposite ends by fixed supports 106,106. Carried by the bar 104 are a plurality of plungers 108,108 each moveable between its illustrated full line and broken line positions by an associated actuator 110, such as a solenoid or pneumatic cylinder, the operation of which is controlled by the controller 18. In an exemplary form of operation, the controller may cause the mechanism 102 to undergo repetitive operating cycles each including an actuation phase and a nonactuation phase. During each nonactuation phase all actuators 110,110 are nonactuated so as to hold their associated plungers 108,108 in the raised position. During each actuation phase those actuators whose plungers are aligned with pattern pieces are actuated to drive those plungers downwardly, and the remaining actuators are not actuated so that the driven plungers push the engaged pattern pieces from the waste material.

It is to be understood that the form of the invention shown and described herein is to be taken as a preferred embodiment of the same, and that various changes in the selection of parts comprising the broadly defined means and in the arrangement of said parts may be resorted to without departing from the spirit of the invention or the scope of the following claims.

What is claimed is:

1. In a system for cutting stacks of pattern pieces from a layup of textile sheet material having a substantial length dimension and an outer surface parallel to said length dimension and where sheet material after cutting consists of cut pattern pieces each of which may vary in size and in shape depending on the choice of pattern selected and adjacent portions of waste material substantially all of which portions of waste material are interconnected with one another to form a single unit, or a small number of units, of waste material extending along said length dimension of said material, an apparatus for separating said cut pattern pieces from said waste material, said apparatus comprising:

means for supporting sheet material for movement forwardly parallel to said length dimension along a generally horizontal path to a separating station following its cutting, and separating means associated with said separating station for causing said cut pattern pieces to follow one path of movement away from said separating station to a first delivery point and for causing said waste material to follow a second path of movement different from said one path away from said separating station to a second delivery point different from said first delivery point, said separating means including means for pulling said waste material from a first point to a second point spaced from said first point so that said waste material is tensioned between said first point and said second point and as a result of such tensioning is constrained to move between said first and second points, the space between said first and second points being part of said one path and said first and second points being so arranged that in moving between them said waste material moves in a direction other than the direction it would move in under the influence of gravity alone such that the leading edge of each cut pattern piece is urged downwardly below a generally horizontal plane pulling the remaining portion of each pattern piece with it below said plane prompted at least by the force of gravity as the corresponding portion of waste material moves in the direction of said second path;

said separating means also including means capable of uniformly engaging said sheet material completely across its width such that said space located between said first point and said second point extends completely transversely across said sheet material without interruption, said one path and said space being so arranged that as said waste material moves past said first point and along said second path cut pattern pieces contained therein are urged by gravity to move through said space from said waste material and to said one path said separating means including means downstream of said uniform engaging means for aiding in the separation of said cut pattern pieces from said waste material by applying forces to said pattern pieces tending to push said pattern pieces from said waste material, and bundling means for bundling the stacks of cut pattern pieces before reaching said separating station.

2. An apparatus as defined in claim 1 further characterized by said separating means including means for vibrating said sheet material generally normal to said outer surface thereof to aid in the separation of said cut pattern pieces from said waste material.

3. An apparatus as defined in claim 1 wherein said means aiding in the separation of said cut pattern pieces from said waste material includes a separating roll extending transversely across said sheet material perpendicularly to said length dimension and having a resilient outer surface pressed against said outer surface of said sheet material.

4. An apparatus as defined in claim 1 wherein said means siding in the separation of said cut pattern pieces from said waste material includes a plurality of plungers moveable generally normal to said outer surface of said sheet material. .

5. An apparatus as defined in claim 4 further characterized by said plungers being spring biased ones, and means for oscillating sad plungers in unison toward and away from said outer surface of said sheet material.

6. An apparatus as defined in claim 4 further characterized by means for individually oscillating each of said plungers toward and away from said outer surface of said sheet material through a controller which also controls the cutting of said sheet material.

7. An apparatus as defined in claim 1 further characterized by said second path of movement being one which extends generally upwardly from said horizontal path while said first path of movement is one which does not extend upwardly from said horizontal path.

8. A method for cutting flexible sheet material comprising:

cutting a quantity of sheet material having a substantial length dimension to convert said sheet material to a plurality of cut pattern pieces each of which may vary in size and shape depending on the choice of pattern selected and adjacent portions of waste material substantially all of which portions of waste material are interconnected with one another to form a single unit, or a small number of units, of waste material extending along said length dimension of said material, and thereafter separating said cut pattern pieces from said waste material by moving said sheet material forwardly along a horizontal path parallel to said length dimension to a separating station, and then constraining said waste material to move along one path away from said separating station to a first delivery station while allowing said cut pattern pieces to move away from said separating station and along a second path to a second delivery station different from said first delivery station, said step of constraining said waste material to move along one path including pulling said waste material between first and second points spaced from on another along said one path so that said waste material is tensioned between said first and second points and as a result of such tensioning is constrained to move between said first and second points, and said first and second points being so arranged that in moving between them said waste material moves in a direction other than the direction it would move in under the influence of gravity alone, and said step of allowing said cut pattern pieces to move to a second delivery station including providing a means capable of uniformly engaging said sheet material completely across its width so as to provide a space between said first and second points extending entirely across the width of said sheet material without interruption so that said pattern pieces as part of their movement along said second path may fall in the direction of gravity from said waste material and through said space such that each cut pattern piece in moving along said second path beginning at its leading edge and followed by its remaining portion moves downwardly below the horizontal path as said waste material is made to follow said one path thereby separating each cut pattern piece regardless of its shape from the waste material said one path being one which extends generally upward from said horizontal path, said sheet material being a layup of sheet material so that stacks of pattern pieces are cut from said layup during said cutting step, and bundling said stacks of cut pattern pieces prior to their reaching said separating station.

9. The method defined in claim 8 further characterized by vibrating said sheet material at said separating zone to aid in the removal of said cut pattern pieces from said waste material.

10. The method defined in claim 8 further characterized by applying forces to said cut pattern pieces at said separating station tending to push said cut pattern pieces from said waste material.

11. A method for cutting flexible sheet material comprising:

providing a cutting station with an upwardly facing horizontal supporting surface, positioning a quantity of sheet material having a substantial length dimension on said supporting surface, cutting said quantity of sheet material by moving a cutter in X and Y coordinate directions relative to said supporting surface to convert said sheet material to a plurality of cut pattern pieces and adjacent portions of waste material substantially all of which portions of waste material are interconnected with one another to form a single unit, or a small number of units, of waste material extending along said length dimension of said material, and thereafter separating said cut pattern pieces from said waste material by moving said sheet material forwardly parallel to said length dimension along a horizontal path forming a continuation of said supporting surface and then pulling said unit, or units, of waste material upwardly for movement along a path of movement extending upwardly from said horizontal path, and without similarly pulling upwardly on said cut pattern pieces, to remove said cut pattern pieces from said waste material such that each cut pattern piece beginning at its leading edge and followed by its remaining portion moves downwardly below said horizontal path as said waste material initially is made to follow said upwardly extending path to thereby separate each cut pattern piece from the waste material regardless of its shape, said step of separating including providing a separating guide means extending transversely of said horizontal path of movement capable of uniformly engaging said sheet material completely across its width and arranged sot hat when said unit, or units, of waste material is, or are, pulled upwardly it is, or they are, pressed against said separating guide means to divert it, or them, from said horizontal path of movement to said upwardly extending path of movement, and said step of pulling said unit, or units, of waste material upwardly being performed in such way that the portion of said unit, or units, of waste material in the vicinity of and immediately following said guide element is tensioned without tensioning any cut pattern pieces appearing therein.

12. The method defined in claim 11 further characterized by applying a resilient pressure to said sheet material along an area extending transversely thereof where said waste material is diverted by said guide means from its horizontal path of movement to its upwardly extending path of movement to tend to press said cut pattern pieces from said unit, or units, of waste material.

13. The method defined in claim 11 further characterized by providing said separating guide means in a form including a rotatable separating roll extending transversely of said material and having a resilient outer surface against which said unit, or units, of waste material is pressed by the tension therein so that said resilient outer surface tends to push said non-tensioned cut pattern pieces from said unit, or units, of waste material.

14. In a system for cutting flexible sheet material having a substantial length dimension and an outer surface parallel to said length dimension, said system comprising:

means providing a cutting station having an upwardly facing horizontal supporting surface for supporting sheet material such as aforesaid for cutting, a cutter head at said cutting station moveable over and relative to said supporting surface in X and Y coordinate directions to cut pattern pieces from said sheet material in such a manner that after such cutting the sheet material consists of cut pattern pieces each of which may vary in size and shape depending on the choice of pattern selected and adjacent portions of waste material substantially all of which portions of waste material are interconnected with one another to form a single unit, or a small number of units, of waste material extending along said length dimension of said material, and an apparatus for separating said cut pattern pieces from said waste material, said apparatus including means for supporting and moving said sheet material forwardly from said cutting station parallel to said length dimension along a generally horizontal path forming a continuation of said supporting surface following its cutting, and separating means located at one point along said horizontal path for pulling said unit, or units, or waste material upwardly for movement along a path of movement extending upwardly from said horizontal path, and without similarly pulling upwardly on said cut pattern pieces, to separate said cut pattern pieces from said waste material, said separating means including guide means capable of uniformly engaging said sheet material completely across its width and located at said one point along said horizontal path defining a curved path along which said unit, or units, of waste material initially moves, or move, in going from said horizontal path of movement to said upwardly extending path of movement such that each cut pattern piece beginning at its leading edge and followed by its remaining portion moves downwardly below the horizontal path as said waste material is made to follow said curved path to thereby separate each cut pattern piece regardless of its shape from the waste material, and said means for pulling said unit, or units, of waste material upwardly being located above said guide means so that the portion of said unit, or units, of waste material located between said guide means and said pulling means is maintained in tension without tensioning any cut pattern pieces appearing therein.

15. A system as defined in claim 14 further characterized by means for delivering the cut pattern pieces separated by said separating means from said unit, or units, of waste material to a first delivery station, and other means for delivering said unit, or units, of waste material separated by said separating means from said cut pattern pieces to another delivery station.

16. A system as defined in claim 14 further characterized by said separating means including means for applying a resilient pressure to said sheet material over an area extending transversely thereto and directed normal to said outer surface thereof, whereby said resilient pressure is resisted by the tensioned waste material and less so by the non-tensioned cut pattern pieces so that said cut pattern pieces tend to be pushed from said waste material by said resilient pressure.

17. A system as defined in claim 14 further characterized by said means for pulling said unit, or units, of waste material upwardly comprising two cooperating rolls, at least one of which is driven, between which said unit, or units, of waste material passes, or pass.

18. A system as defined in claim 14 further characterized by said guide means being a separating roll rotatable about an axis extending transversely of said horizontal path, said separating roll being located immediately above said sheet material and having a normally uniform cylindrical outer surface engageable with said outer surface of said sheet material.

19. A system as defined in claim 18 further characterized by said outer surface of said separating roll being a resilient one so as to be resiliently compressed by the tension in said unit, or units, of waste material passing thereover and so as to be less compressed by the non-tensioned cut pattern pieces passing thereover with the result said resilient roll surface tends to push said cut pattern pieces from said tensioned unit, or units, of waste material to aid in the separation of said pattern pieces from said unit, or units, of waste material.

20. A system as defined in claim 18 further characterized by a resilient outer surface defining said separating roll and being formed by said roll including a multitude of resiliently flexible bristles which normally extend radially outwardly relative to the axis of said roll and have outer ends defining said resilient outer surface.

21. A system as defined in claim 14 for use in an application where said sheet material consists of a layup of sheet material with said cutter head cutting stacks of said pattern pieces from such layup of sheet material, and further characterized by a bundling means for bundling the stacks of cut pattern pieces before reaching said point along said horizontal path at which said pattern pieces are separated from said waste material.

22. A system as defined in claim 14 further characterized by said means for supporting and moving said sheet material forwardly along a generally horizontal path following its cutting being a conveyor table.

23. A system as defined in claim 22 further characterized by said conveyor table having an endless conveyor ban trained around forward and rear end wheels located at opposite ends of said table so that said conveyor band includes an upper run extending between said wheels having an upwardly facing surface for supporting said sheet material, said point along said horizontal path at which said unit, or units, of waste material is, or are, pulled upwardly being located adjacent said forward one of said wheels so that as said unit, or units, of waste material is, or are, pulled upwardly along said curved path cut pattern pieces appearing in said unit, or units, of the waste material are free to drop below said horizontal surface as they move past said separating means.

24. A system as defined in claim 23 further characterized by said separating means including means for applying a resilient pressure to said sheet material over an area extending transversely thereto and directed normal to said outer surface thereof, whereby said resilient pressure is resisted by the tensioned waste material and less so by the non tensioned cut pattern pieces so that said cut pattern pieces tend to be pushed from said waste material by said resilient pressure.

25. A system as defined in claim 23 further characterized by said conveyor table having an endless conveyor band trained around forward and rear wheels located at opposite ends of said table so that said conveyor band includes an upper run extending between said wheels having an upwardly facing surface which supports said sheet material, said separating means including a separating roll located adjacent said forward wheel of said conveyor table so that the cut sheet material passes between said forward wheel and said separating roll in moving forwardly beyond said point, and said means for pulling said unit, or units, of waste material upwardly comprising two rolls, at least one of which is driven, located above said separating roll and between which said unit, or units, of sheet material passes, or pass.

26. A system as defined in claim 25 further characterized by said separating roll having a central axis of rotation and a resilient outer surface which is resiliently compressed by said tensioned unit, or units, of waste material and which is less compressed by said non.tensioned cut pattern pieces, whereby said resilient outer surface tends to push said cut pattern pieces away from said unit, or units, of waste material to aid in separating said cut pieces from said unit, or units, of waste material.

27. A system as defined in claim 26 further characterized by said resilient outer surface of said separating roll being formed by said roll including a multitude of resiliently flexible bristles which normally extend radially outwardly relative to said axis of said roll and have outer ends defining said resilient surface.

28. In a system for cutting stacks of pattern pieces from a layup flexible sheet material having a substantial length dimension and where the sheet material after cutting consists of cut pattern pieces each of which may vary in size and in shape depending on the choice of pattern selected and adjacent portions of waste material substantially all of which portions of waste material are interconnected with one another to form a single unit, or a small number of units, of waste material extending along said length dimension of said material, an apparatus for separating said cut pattern pieces from said waste material, said apparatus comprising:

means for supporting sheet material for movement forwardly parallel to said length dimension along a generally horizontal path to a separating station following its cutting, and separating means located at said separating station, said means for supporting sheet material terminating at said separating station so as to provide a space extending transversely across the entire width of said sheet material without interruption at said separating station through which space material may fall downwardly under the influence of gravity from said horizontal path such that each cut pattern piece in moving along said horizontal path is initially moved downwardly starting at its leading edge and followed by its remaining portion below the horizontal path to thereby separate each cut pattern piece regardless of its shape form the waste material, and said separating means including means for constraining said waste material to move away from said separating station along a waste discharge path so as not to fall through said space, whereby as sheet material moves past said separating station cut pattern pieces fall through said space to a first delivery station and waste material moves through said waste discharge path to a second delivery station different from said first delivery station, said means for constraining said waste material to move along said waste discharge path including means capable of uniformly supporting said sheet material completely across its width for pulling said waste material across said space from a first point to a second point so that said waste material is tensioned between said first and second points and constrained to move therebetween with said first and second points being points along said waste discharge path and being so arranged that in moving between them said waste material moves in a direction other than the direction it would have moved in under the influence of gravity alone said waste discharge path being one which extends generally upward from said horizontal path, and bundling means for bundling the stacks of cut pattern pieces before reaching said separating station.

* * * * *